US006599122B2

(12) United States Patent
Hunault et al.

(10) Patent No.: US 6,599,122 B2
(45) Date of Patent: Jul. 29, 2003

(54) GAS COOKING APPLIANCE WITH ERROR-PROOFING REGARDING THE POSITIONING OF THE BURNER HEAD

(75) Inventors: Patrick Hunault, Montbazon (FR); Bernard Dane, Montbazon (FR)

(73) Assignee: Sourdillon (FR)

( * ) Notice: Subject to any disclaimer, the term of this patent is extended or adjusted under 35 U.S.C. 154(b) by 0 days.

(21) Appl. No.: 10/223,430

(22) Filed: Aug. 19, 2002

(65) Prior Publication Data

US 2003/0039937 A1 Feb. 27, 2003

(51) Int. Cl.[7] ..... F23D 14/62
(52) U.S. Cl. ..... 431/354; 126/39 R
(58) Field of Search ..... 431/354, 284, 431/278; 126/39 R, 39 E, 214 R

(56) References Cited

U.S. PATENT DOCUMENTS 3,635,209 A * 1/1972 Vignes ..... 126/39 H
6,299,436 B1 * 10/2001 Huang ..... 431/354
6,318,993 B1 * 11/2001 Huang ..... 431/354

FOREIGN PATENT DOCUMENTS

| | | |
|---|---|---|
| WO | WO 96/06304 | 2/1996 |
| WO | WO 00/40900 | 7/2000 |

* cited by examiner

*Primary Examiner*—Alfred Basichas
(74) *Attorney, Agent, or Firm*—Piper Rudnick

(57) ABSTRACT

Gas cooking appliance equipped with a top plate (1) having at least one region (7) for the attachment of an injector (6) of a gas burner (4) and for supporting a head (12) of the burner coaxial with the injector (6); the region (7) has a non-circular contour, particularly a polygonal contour, and the burner head (12) has legs (16) by which it rests on the region (7), the number and arrangement of which legs are such that they collaborate with the sides of the non-circular contour of the region (7) so that the burner head (12) can occupy only a determined and limited number of angular positions while at the same time being arranged coaxial with the injector (6) and so that, for any incorrect positioning—in terms of orientation and/or in terms of centring—of the head (12), the latter rests on the top plate such that it is inclined and that the incorrectness is thus visible.

8 Claims, 4 Drawing Sheets

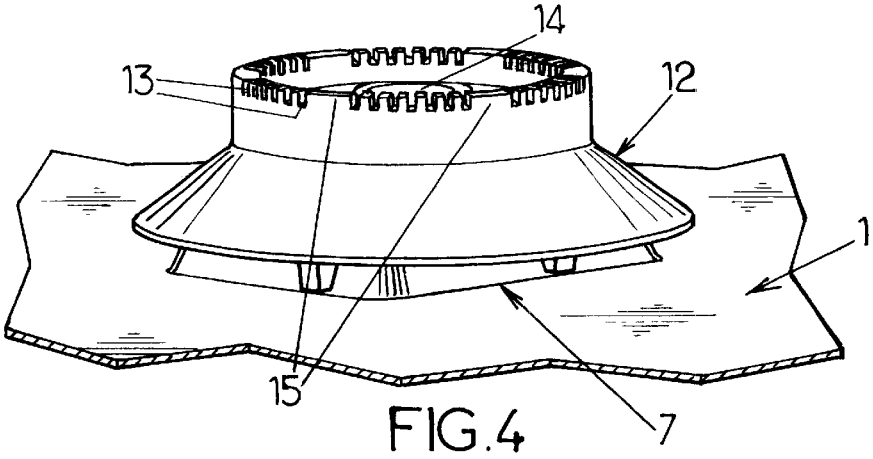
FIG.4
FIG.5.
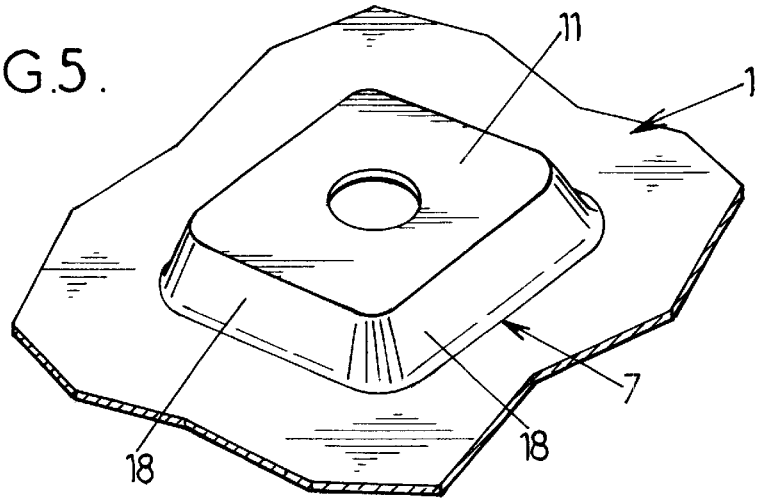
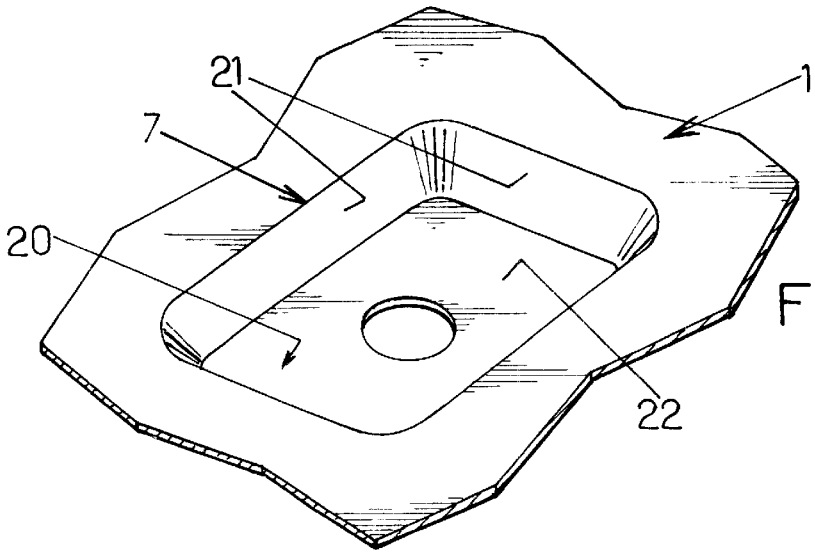
FIG.6.

GAS COOKING APPLIANCE WITH ERROR-PROOFING REGARDING THE POSITIONING OF THE BURNER HEAD

FIELD OF THE INVENTION

The present invention relates to improvements made to gas cooking appliances equipped with a top plate having at least one region for the attachment of an injector of a gas burner and for supporting a head of the said burner coaxial with the said injector and above the said plate with primary air being drawn in from on top of the plate.

DESCRIPTION OF THE PRIOR ART

Habitually, the gas burner is surmounted by a grating itself resting on the top plate and able to support the vessels with their bottoms situated at a given height over the burner. Whatever the construction of the grating (cast iron grating, steel wire grating), flames coming into contact with an element (finger, rod) of the grating leads to increased CO emissions and these may become excessive with regard to the requirements laid down in the standards and health requirements.

In order to avoid, or at least to lessen, this drawback, it is known practice for the formation of flames under the metal parts of the grating to be prevented: this is obtained by eliminating certain flame orifices on the periphery of the burner head.

However, for such an arrangement to prove effective, it is then necessary for the burner head to be positioned correctly so that the regions which have no flame orifices lie exactly under the metal parts of the grating. Now, it is not, in practice, possible to rely entirely upon the user to put the burner head back in the correct angular position after a cleaning operation.

Furthermore, independently of the correct angular positioning of the burner head with respect to the grating, it is also essential that the burner head rest on the top plate in a situation of as perfect as possible coaxiality with the injector fixed to the plate. Here again, it is not possible to rely entirely upon the user to ensure this coaxiality.

SUMMARY OF THE INVENTION

It is therefore essentially an object of the invention to provide an improved arrangement of a gas burner of the kind in question, so that the correct positioning of the burner head no longer relies simply on the free will of the user, the means implemented to these ends having, however, not to lead to any appreciable complication in manufacture or any significant additional cost.

To these ends, a cooking appliance as mentioned in the preamble is characterized, being arranged in accordance with the invention, in that the aforementioned region of the top plate, whether it be formed integrally with the plate or attached, has a non-circular contour and in that the burner head has legs by which it rests on the aforementioned region of the top plate, the number and arrangement of which legs are such that they collaborate with the sides of the said non-circular contour of the said region so that the burner head can occupy only a determined and limited number of angular positions while at the same time being arranged coaxial with the injector and so that, for any incorrect positioning—in terms of orientation and/or in terms of centring—of the head, the latter rests on the top plate such that it is inclined and that the incorrectness is thus visible.

In a preferred embodiment, the said region of the top plate is a non-circular plateau surmounting the rest of the said plate, and the number and arrangement of the legs of the burner head are suited to these legs collaborating with the lateral faces of the non-circular pyramid bordering the plateau.

The arrangements of the invention may also be implemented by contriving for the said region of the top plate to be a non-circular dish extending under the rest of the said plate, and for the number and arrangement of the legs of the burner head to be suited to these legs collaborating with the lateral faces of the non-circular pyramid bordering the dish.

The arrangements of the invention may also be implemented in cases where the said region of the top plate is coplanar with the rest of the plate and for example comprises hollow indentations distributed about the said non-circular contour and in which the ends of the legs of the burner head rest.

A preferred, although non-limiting, embodiment of the foregoing arrangements consists in the aforementioned region of the top plate having a polygonal contour.

In this case, a preferred embodiment of such an arrangement may consist in the said region of the top plate having a rectangular shape and in the number of possible correct positions of the burner head being two. Another preferred embodiment of these arrangements may consist in the said region of the top plate having a square shape and in the number of possible correct positions of the burner head being four. Of course, other configurations (region of pentagonal, hexagonal or octagonal shape in particular) are conceivable.

However, the aforementioned region of the top plate can just as easily be elongate of revolution, particularly oval or elliptical, with the same advantages being obtained.

The arrangements according to the invention make it possible simultaneously to ensure physical error-proofing regarding the angular positioning of the burner head and its coaxiality with respect to the injector while at the same time allowing a simple visual check (burner head sitting crooked on the top plate) in the event of incorrect positioning (poor angular positioning, lack of coaxiality with the injector).

The means implemented are simple and have practically no impact on the cost of manufacture since the configuration (flat, hollow or plateau-shaped) of the region concerned of the top plate is down to the actual design of the burner and of the cooking appliance and since arranging the burner with the primary air supply from on top of the plate entails having legs: implementation of the arrangements of the invention has an impact only on the geometric shape given to the aforementioned region and on the geometric arrangement of the legs in relation to the shape of the support region.

BRIEF DESCRIPTION OF THE DRAWINGS

The invention will be better understood upon reading the detailed description which follows of certain embodiments which are given merely by way of non-limiting examples. In this description, reference is made to the appended drawings in which:

FIG. 4 is a partial side view in perspective showing the burner head of FIG. 3 mounted in the plate part of FIG. 2;

FIG. 5 is a perspective view from above illustrating an alternative form of embodiment of the top plate part of FIG. 2;

FIG. 6 is a perspective view from above of another embodiment of part of the top plate arranged according to the invention;

DETAILED DESCRIPTION OF THE INVENTION

Figure 1:
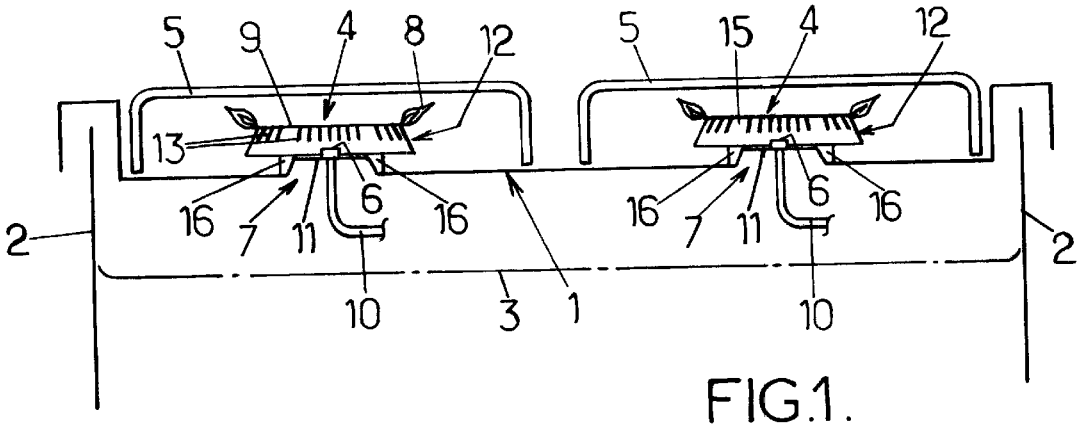
FIG. 1 is a very schematic view, in section, of a preferred embodiment of a gas cooking appliance arranged in accordance with the invention.

Reference is made first of all to FIG. 1 where a sectional view of a gas cooking appliance of the type at which the invention is aimed is depicted very schematically. The appliance comprises a top plate 1 supported by two lateral walls 2, it being possible for a bottom plate 3 to be provided underneath to isolate the cooking appliance from an underlying part which may house another kitchen appliance.

The top plate supports at least one gas burner 4 (two burners are illustrated in FIG. 1) which are surmounted by a grating 5 for supporting a vessel.

At each location where a burner 4 is to be located, the top plate 1 has a specific region 7 at the centre of which a gas injector 6 is fixed, to which injector is connected a gas supply pipe 10. This specific region 7 may be integral with the top plate 1 or may just as easily be attached to this plate.

In the example illustrated in FIG. 1, each specific region 7 projects above the top plate and in its central part is in the form of a plateau 11 at the centre of which the injector 6 is fixed.

Over the specific region 7 is arranged the head 12 of the burner 4 which is capped by a cap or cover 9. The burner head 12 comprises orifices 13 distributed peripherally and through which the flames 8 exit.

Such gas burners are arranged in ultra-flat shape and, in the known way, are provided with a radial annular Venturi defined between the upper edge of a vertical central well 14 (visible in FIG. 3) coaxial with the injector, and the underside facing it of the cap.

A burner arrangement of the type in question is described for example in document FR 01/05232 in the name of the Applicant Company.

To avoid excessive emissions of CO occurring when the flames come into contact with the fingers or rods of the support grating 5, the flame orifices 13 are distributed peripherally with discontinuities 15 (portions without orifices visible in FIGS. 1 to 4) facing the fingers of the grating 5.

In order for the burner head 12 to be able to be supported by the top plate 1 removably, for it to be supported at the appropriate height over the specific region 7 (here with respect to the plateau 11) and under the grating 5, and for it to be positioned correctly in terms of angle with the portions free of flame orifices 13 situated to correspond with the fingers of the grating 5, provision is made for:

the peripheral region 7 to be given a special shape and the burner head 12 to be equipped with legs 16 which are dimensioned, configured and arranged in such a way that they collaborate with the said specific region 7 in order to afford the aforementioned desired results.

It is emphasized here that the support of the burner head 12 at a correct height over the top plate 1 is also important for defining an appropriate annular gap between the lower edge of the burner head 12 and the top plate 1, through which gap the primary air needed for the burner to operate and which, in this type of burner, passes over the top of the plate 1, passes.

In addition, it will also be emphasized that the burner head 12 has to be arranged perfectly coaxial with the injector 6 so that it operates optimally.

This being so, the desired results are achieved in a simple way by giving the specific region 7 a non-circular geometric shape and by arranging the support legs 16 in a similar geometric configuration. According to the invention, this region 7 may have a polygonal shape or be elongate of revolution.

Figure 2:
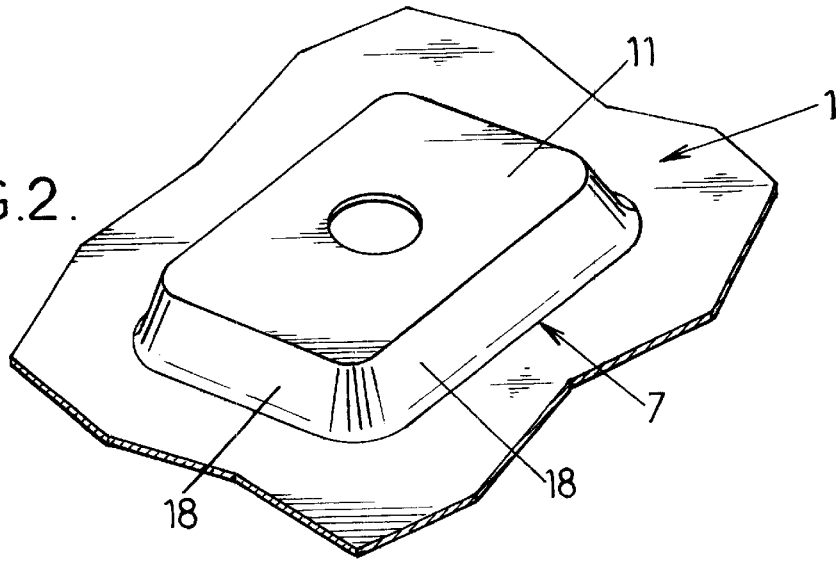
FIG. 2 is a perspective view from above of part of the top plate of the appliance of FIG. 1.

In the example illustrated in FIG. 2, the specific region 7 is polygonal of quadrilateral shape and more specifically is rectangular, preferably with rounded corners.

Figure 3:
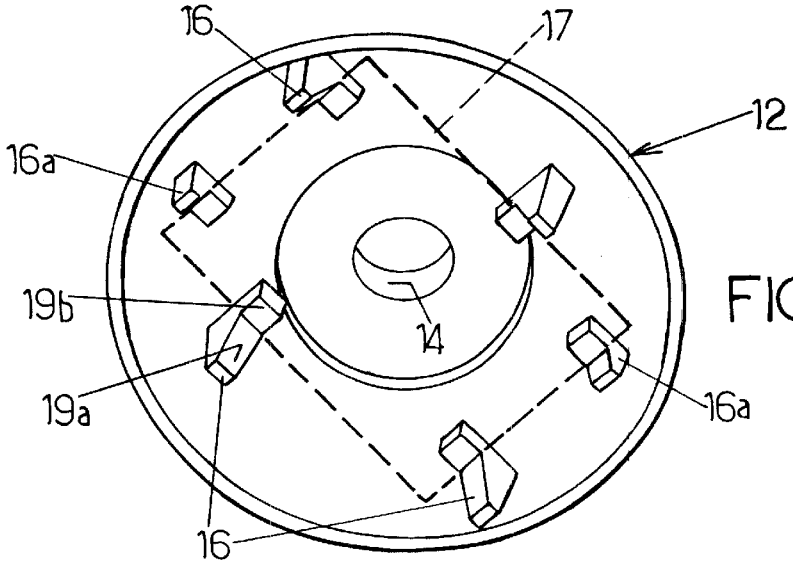
FIG. 3 is a perspective view from beneath of the head of a burner of the appliance of FIG. 1, appropriate for collaborating with the part of the plate shown in FIG. 2.

To complement this, as visible in FIG. 3, the burner head 12 is equipped with support legs 16 arranged on a contour which is also quadrilateral, particularly rectangular, and which in the drawing has been embodied by the rectangle 17 shown in dashed line. The legs 16 are intended to contact the flanks 18 surrounding the rectangular plateau 11, and, as these flanks 18 are significantly inclined with respect to the vertical, the legs 16 have a corresponding inclination. In the configuration illustrated in FIGS. 2 and 3, legs 16, of which there are four, arranged in such a way as to rest approximately at the middles of the flanks 18 may, in theory, be appropriate. However, to obtain more precise positioning, it is advantageously possible to use six legs 16, as illustrated in FIG. 3, with two legs corresponding to the short sides of the rectangular contour and just one leg corresponding to the long sides of the rectangular contour.

This being so, burner head 12 can be positioned on the specific region 7 with just two possible angular orientations offset by 180° from one another and with correct coaxiality with the injector, as illustrated in FIG. 4.

To afford an improved error-proofing effect and in particular to avoid the burner head being placed at a location for which it is not intended, it is possible to envisage offsetting some of the legs: for example, as visible in FIG. 3, the two legs situated on the long sides of the contour 17 are offset on each side of the median axes of these long sides.

In addition, it is possible to contrive for the legs to not all have the same height, as illustrated in FIG. 3 where two diagonally opposed legs 16*a* are shorter than the other four.

To obtain precise heightwise positioning of the burner head 12 with respect to the top plate 1, each leg 16 (including the short legs 16*a*) is in the overall shape of an L, with a lateral bearing surface 19*a* able to collaborate with the corresponding flank 18 and a bottom bearing surface 19*b* via which it rests on the plateau 11.

It will thus be appreciated that the arrangements according to the invention, which have just been described more particularly in relation to FIGS. 2 and 4 which constitute a preferred embodiment of the invention, can give rise to numerous alternative forms and adaptations.

In particular, in a simple way, as illustrated in FIG. 5, the specific region 7 may be square in shape, with a square plateau 11, particularly with rounded corners, while the number of legs 16 may be kept at six, may be increased to a higher number or may be reduced to four, these legs being arranged on a square contour. Such an arrangement allows the burner head to be positioned with equal ease in four angular orientations which are offset by 90° from one another.

It is of course possible to give the specific region 7 a polygonal shape with a higher number of sides, and this leads to the burner head also having a higher number of possible angular orientations (pentagonal pyramid shape allowing five angular positions offset by 72° from one another; hexagonal pyramid shape allowing six angular positions offset by 60° from one another; etc.).

Furthermore, the devices of the invention which have just been described, in relation to a polygonal pyramid shape specific region 7 defining a plateau 11 sitting over the top plate 1, represent one preferred embodiment. However, such an arrangement is not the exclusive one in the invention, and other solutions are conceivable without departing from the scope of the invention.

In particular, it is possible for the specific region 7 to have the opposite shaping to the previous shape, that is to say to be in the shape of a dish 20 with a polygonal contour (hollow pyramid) as illustrated in FIG. 6. The dish 20 has a bottom 22 bordered by inclined flanks 21.

Figure 7:
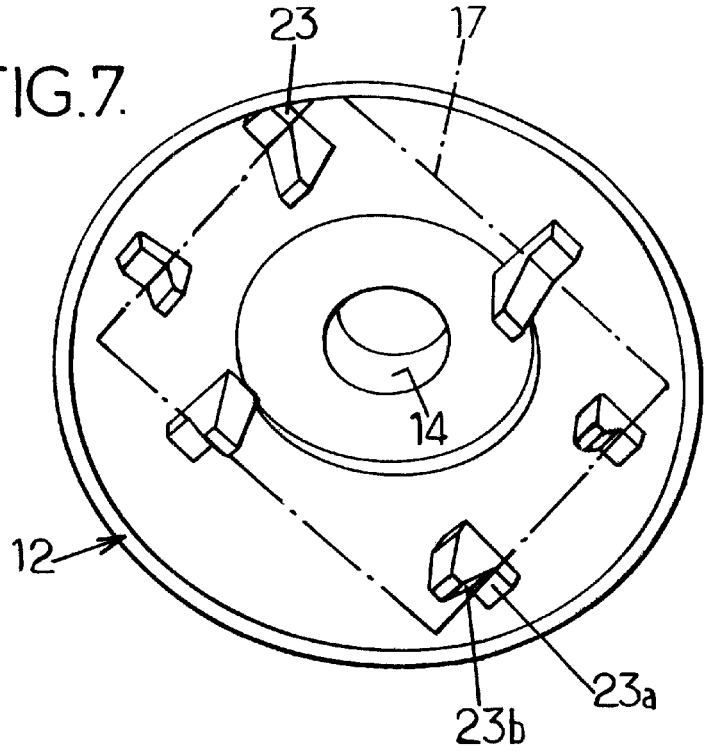
FIG. 7 is a perspective part view from beneath of an other embodiment of the head of a burner able to collaborate with the plate part shown in FIG. 6.

To complement this, as illustrated in FIG. 7, the burner head 12 is equipped with legs 23 which have the same shaping as the legs 16 visible in FIG. 3 but are inverted so that the inclined bearing surfaces 23*a* can collaborate with the flanks 21 and so that the horizontal bearing surfaces 23*b* can bear on the edge of the plate 1 surrounding the dish 20.

Here again, the dish 20 may have any desired polygonal shape for obtaining the required number of correct angular positions of the burner head 12.

Figure 8:
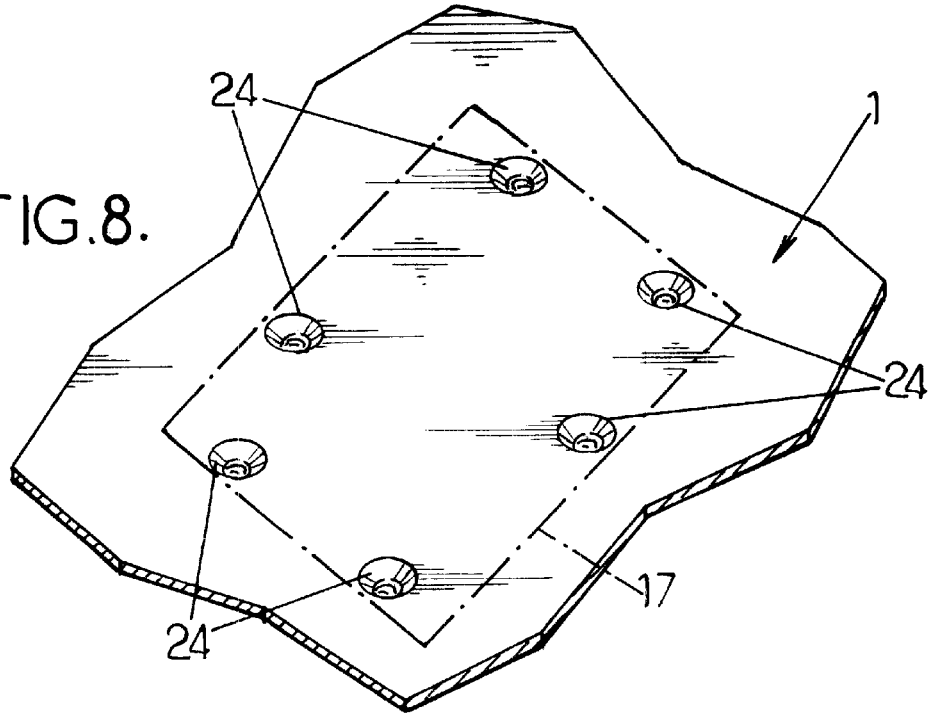
FIG. 8 is a perspective view from above of yet another embodiment of a top plate part arranged according to the invention.

It is also conceivable for the specific region 7 to be formed neither as a hollow nor as a projection to the top plate 1, but for it simply to be coplanar with the plate 1. To embody the geometric shape required with a view to the desired error-proofing, it is possible, as illustrated in FIG. 8, to give it hollow indentations 24 which are arranged in a predetermined polygonal contour, which contour reproduces the positioning of the legs with which the burner head 12 is equipped. In FIG. 8, the hollow indentations are supposed to be able to accommodate the ends of the legs 16 shown in FIG. 3 and are arranged accordingly. It may be contrived for it to be the ends of the legs 16 which rest in the bottom of the corresponding hollow indentations 24 (in which case the surfaces 19*a*, 19*b* become needless), or, on the other hand, for bearing to be via the surfaces 19*a*, 19*b* bearing on the edges of the respective indentations, while the ends of the legs do not come into contact with the bottoms of the respective indentations.

Figure 9:
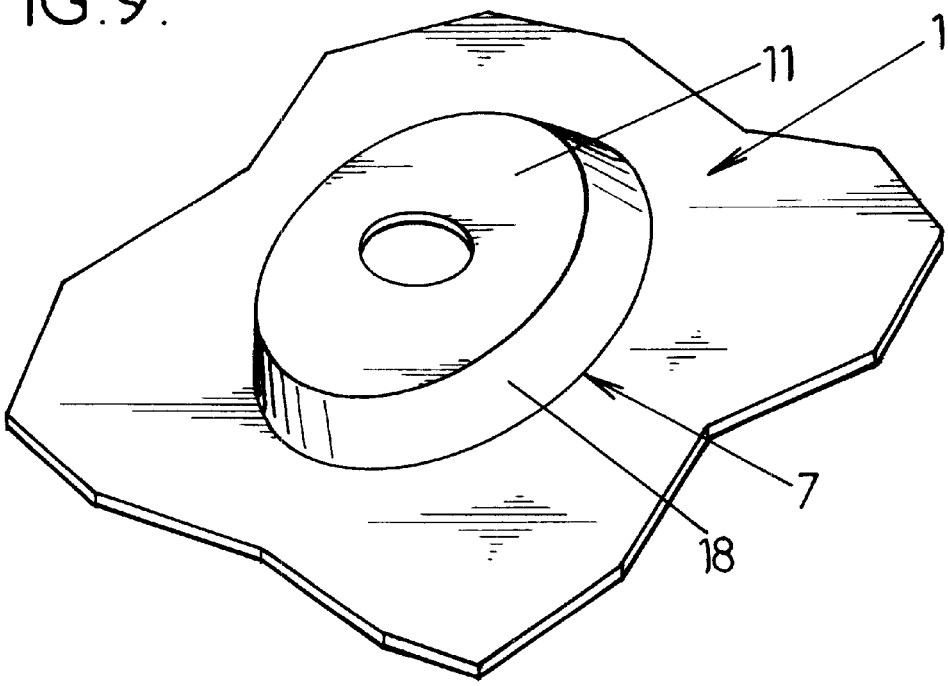
FIG. 9 is a perspective view from above of yet another embodiment of a top plate part arranged in accordance with the invention.
Figure 10:
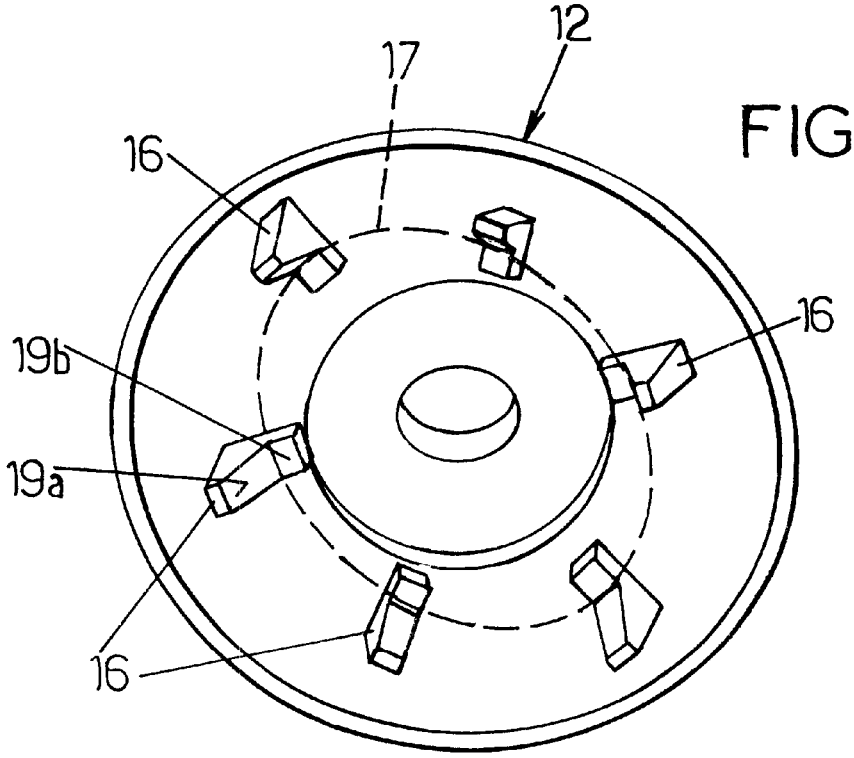
FIG. 10 is a part view from beneath of another embodiment of the burner head able to collaborate with the plate part shown in FIG. 9.

As suggested above, it is also conceivable for the specific region 7 not to be polygonal, but to be elongate of revolution, for example elliptical or oval. An example of an arrangement of this type is illustrated in FIGS. 9 and 10, which are based on the aforementioned FIGS. 2 and 3 (the same numerical references being kept).

What is claimed is:

1. Gas cooking appliance equipped with a top plate having at least one region for the attachment of an injector of a gas burner and for supporting a head of the said burner coaxial with the said injector and above the said plate with primary air being drawn in from on top of the plate, wherein said region of the top plate has a closed non-circular contour and in that the burner head has legs by which it rests on the aforementioned region of the top plate, the number and arrangement of which legs are such that they collaborate with the sides of the said non-circular contour of the said region so that the burner head can occupy only a determined and limited number of angular positions while at the same time being arranged coaxial with the injector and so that, for any incorrect positioning—in terms of orientation and/or in terms of centring—of the head, the latter rests on the top plate such that it is inclined and that the incorrectness is thus visible.

2. Gas cooking appliance according to claim 1, wherein said region of the top plate is a non-circular plateau surmounting the rest of the said plate, and wherein the number and arrangement of the legs of the burner head are suited to these legs collaborating with the lateral faces of the non-circular pyramid bordering the plateau.

3. Cooking appliance according to claim 1, wherein said region of the top plate is a non-circular dish extending under the rest of the said plate, and wherein the number and arrangement of the legs of the burner head are suited to these legs collaborating with the lateral faces of the non-circular pyramid bordering the dish.

4. Cooking appliance according to claim 1, wherein said region of the top plate is coplanar with the rest of the plate and wherein the number and arrangement of the ends of the legs of the burner head are suited to the ends of these legs collaborating with respective hollow indentations arranged around the aforementioned non-circular contour.

5. Cooking appliance according to claim 1, wherein said region of the top plate has a polygonal contour.

6. Cooking appliance according to claim 5, wherein said region of the top plate is of rectangular shape, and wherein the number of possible correct positions of the burner head is two.

7. Cooking appliance according to claim 5, wherein said region of the top plate is of square shape, and wherein the number of possible correct positions of the burner head is four.

8. Cooking appliance according to claim 1, wherein the legs of the burner head each comprise a lateral bearing surface able to collaborate with a corresponding flank of the specific region of the top plate and a horizontal bearing surface able to collaborate with a horizontal surface of the said specific region or of the plate.

* * * * *

UNITED STATES PATENT AND TRADEMARK OFFICE

CERTIFICATE OF CORRECTION

PATENT NO. : 6,599,122 B2
DATED : July 29, 2003
INVENTOR(S) : Patrick Hunault and Bernard Dane It is certified that error appears in the above-identified patent and that said Letters Patent is hereby corrected as shown below:

Title page,
Insert item:
-- [30] Foreign Application Priority Data
Aug. 21, 2001 (FR) …… 01 10952 --

Signed and Sealed this

Twenty-seventh Day of April, 2004

JON W. DUDAS
*Acting Director of the United States Patent and Trademark Office*